US007270436B2

(12) United States Patent
Jasper

(10) Patent No.: US 7,270,436 B2
(45) Date of Patent: Sep. 18, 2007

(54) BACKLIGHTING FOR ELECTRICAL COVER PLATES

(76) Inventor: Michael Jasper, 4827 Red Fish Rd., Bacliff, TX (US) 77518

( * ) Notice: Subject to any disclaimer, the term of this patent is extended or adjusted under 35 U.S.C. 154(b) by 59 days.

(21) Appl. No.: 10/504,235

(22) PCT Filed: Feb. 7, 2003

(86) PCT No.: PCT/US03/03898

§ 371 (c)(1),
(2), (4) Date: May 4, 2005

(87) PCT Pub. No.: WO03/067148

PCT Pub. Date: Aug. 14, 2003

(65) Prior Publication Data

US 2005/0207136 A1 Sep. 22, 2005

Related U.S. Application Data

(60) Provisional application No. 60/355,443, filed on Feb. 7, 2002.

(51) Int. Cl.

| | |
|---|---|
| ***F21V 33/00*** | (2006.01) |
| *H01H 9/02* | (2006.01) |
| *H01H 9/18* | (2006.01) |
| *G09F 13/20* | (2006.01) |

(52) U.S. Cl. ..... 362/95; 362/84; 174/66

(58) Field of Classification Search ..... 362/253, 362/95, 84, 85; 439/490, 491; 174/66, 67
See application file for complete search history.

(56) References Cited

U.S. PATENT DOCUMENTS

| | | | | |
|---|---|---|---|---|
| 3,708,894 | A * | 1/1973 | Savage, Jr. | 434/235 |
| 4,323,351 | A * | 4/1982 | Goldsmith | 434/274 |
| 4,755,913 | A * | 7/1988 | Sleveland | 362/95 |
| 5,642,939 | A * | 7/1997 | Comardo | 366/132 |
| 5,683,166 | A * | 11/1997 | Lutzker | 362/84 |
| 6,000,807 | A * | 12/1999 | Moreland | 362/95 |
| 6,547,411 | B1 * | 4/2003 | Dornbusch | 362/95 |
| 6,578,980 | B1 * | 6/2003 | Chen et al. | 362/95 |
| 6,642,452 | B2 * | 11/2003 | Masson | 174/66 |

* cited by examiner

*Primary Examiner*—Alan Cariaso
*Assistant Examiner*—Leah S. Lovell
(74) *Attorney, Agent, or Firm*—Frederick W. Mau, II

(57) ABSTRACT

A cover plate (5) for use with an electrical supply. In one embodiment, the backlit cover plate comprises a plate (5), the plate (5) including a window (15) therein; and backlighting, the backlighting powered by the electrical supply (55), the backlighting (20) disposed to be mounted on the plate (5) so as to shine through the window (15). Optional labels (45) may be provided through which the backlighting may shine, thereby illuminating data on the labels (45) from behind. In a disclosed embodiment, the backlighting (20) comprises electroluminescent lighting.

17 Claims, 2 Drawing Sheets

BACKLIGHTING FOR ELECTRICAL COVER PLATES

RELATED APPLICATIONS

Applicant claims priority to Provisional Application No. 60/355,443, filed Feb. 7, 2002 in the United States Patent and Trademark Office.

FIELD OF THE INVENTION

This application relates generally to the field of electrical fixtures, and more specifically to backlighting for electrical cover plates and embodiments of same using techniques such as electroluminescence.

BACKGROUND OF THE INVENTION

In both homes and commercial establishments, cover plates are conventionally attached to the walls or other surfaces to cover the electrical connections of switches and power outlets. Securing of the cover plate is well known in the art. Typically, the cover plate is secured to the receiving surface by two screws. In an example of a light switch, as is well known, a light is typically turned on and off by flipping the light switch in the appropriate on or off position. It is common for several switches to be located in one general region, such as a door. In order to visually identify which light is turned on or off by a certain light switch, a stick-on label such as a "Dymo" label may need to be affixed to the cover plate identifying the particular light controlled by that light switch. Further, if a light is not working when the controlling light switch is in the on position, a problem is presented because a person entering a darkened space cannot visually identify whether the problem is the light bulb or the circuit connected to the light switch. The light bulb must be changed to determine if the problem is the light bulb. If the light still does not work after changing the light bulb, the breaker must be checked to determine whether electricity is being supplied to the light switch. If the breaker has not interrupted the flow of electricity to the light switch, one may not be able to determine whether the source of the problem is the light switch or the light without further inquiry.

With a power outlet, typically a power cord of an electrical device is plugged into one of the outlets of the power outlet through openings in the wall plate. Through this connection, electricity is supplied to the electrical device. If the electrical device is not operating when turned on, a problem is presented because one cannot visually identify whether the electrical device is malfunctioning or the electrical circuit at the power outlet is not providing electricity. Typically, one tests the power outlet or the electrical device to determine the source of the problem. In addition, a person may not be able to visually identify at the power outlet which electrical device is plugged into a particular outlet. Typically, one follows the power cord to the particular electrical device. The person may also affix a label to the wall plate identifying the particular electrical device.

SUMMARY OF THE INVENTION

A backlit cover plate for use with an electrical supply addresses these and other needs in the art. The backlit cover plate comprises a plate, the plate including a window therein, and backlighting powered by the electrical supply, the backlighting disposed to be mounted on the plate so as to shine through the window. The backlit cover plate may optionally further comprise a switch on the electrical supply, the switch having an operating mechanism to alternatively connect or interrupt the electrical supply, the plate further comprising an opening, the operating mechanism of the switch receivable in the opening, the backlighting connected to the power supply so as to be energized when the switch interrupts the power supply. In addition, the backlit cover plate may optionally further comprise a label, the label including a translucent background and an opaque foreground comprising data to be communicated, the label disposed to be mounted so that the backlighting shines through the window and the label. It will be seen that a technical advantage of the invention includes backlighting a portion of a cover plate, addressing some of the problems encountered by conventional cover plates. For instance, embodiments of the invention allow visual monitoring of an electrical circuit at a light switch or power outlet.

Further technical advantages include visual identification of light switches and power outlets, which, especially in conjunction with a backlit label, assists an individual in not turning on the wrong light or plugging an appliance into the wrong power outlet by mistake. When in use with a power outlet, a further technical advantage includes freeing up all available outlets of a power outlet, without using up one outlet to illuminate the cover plate itself. The invention also allows an individual to use the proper light switch or power outlet when lighting is poor, which enhances convenience and improves safety to the individual. The invention further allows different colors to be used for the backlighting, which allows an individual to use the invention for aesthetics or color coding. Although the invention is conveniently embodied on a cover plate for use with standard household AC electrical supply, the invention is not limited. In this regard, it will be appreciated that other embodiments are possible for any type of power supply in any environment. Note also that the invention is not limited to AC embodiments. Although the invention is described herein with respect to embodiments using electroluminescence for backlighting powered by AC supply, it will be seen that the principles of the invention apply with equivalent enabling effect to embodiments relying on DC power supply. The foregoing has outlined the features and technical advantages of the present invention in order that the detailed description of the invention that follows may be better understood. Additional features and advantages of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE INVENTION

Figure 2:
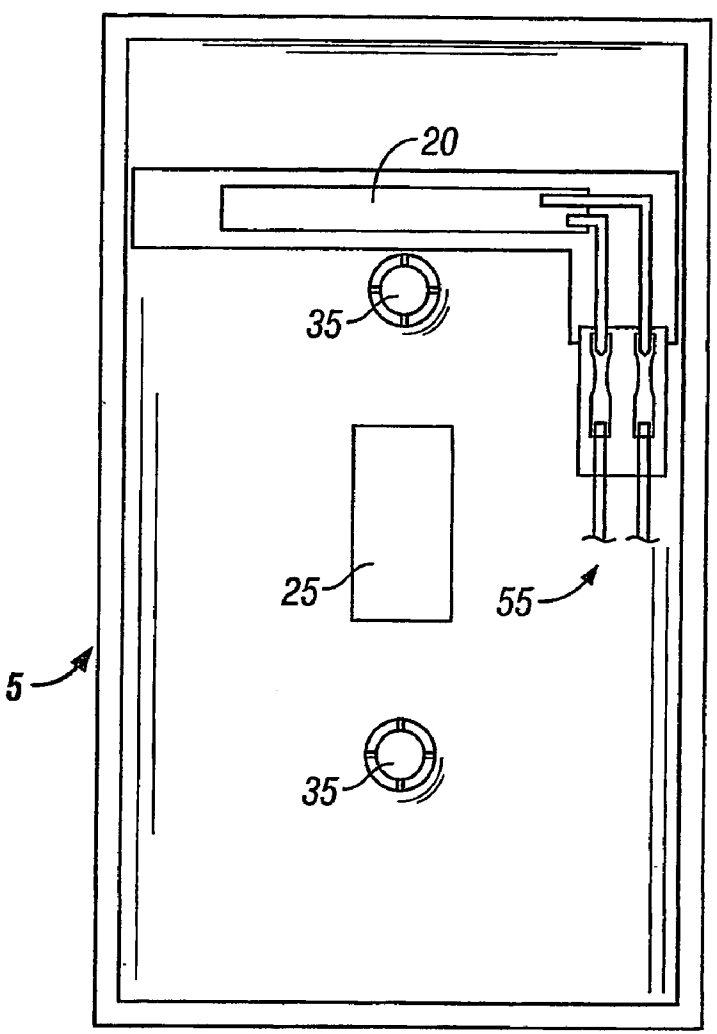
FIG. 2 is a plane view of the embodiment of switch cover plate invention illustrated from the reverse side of FIG. 1.
Figure 1:
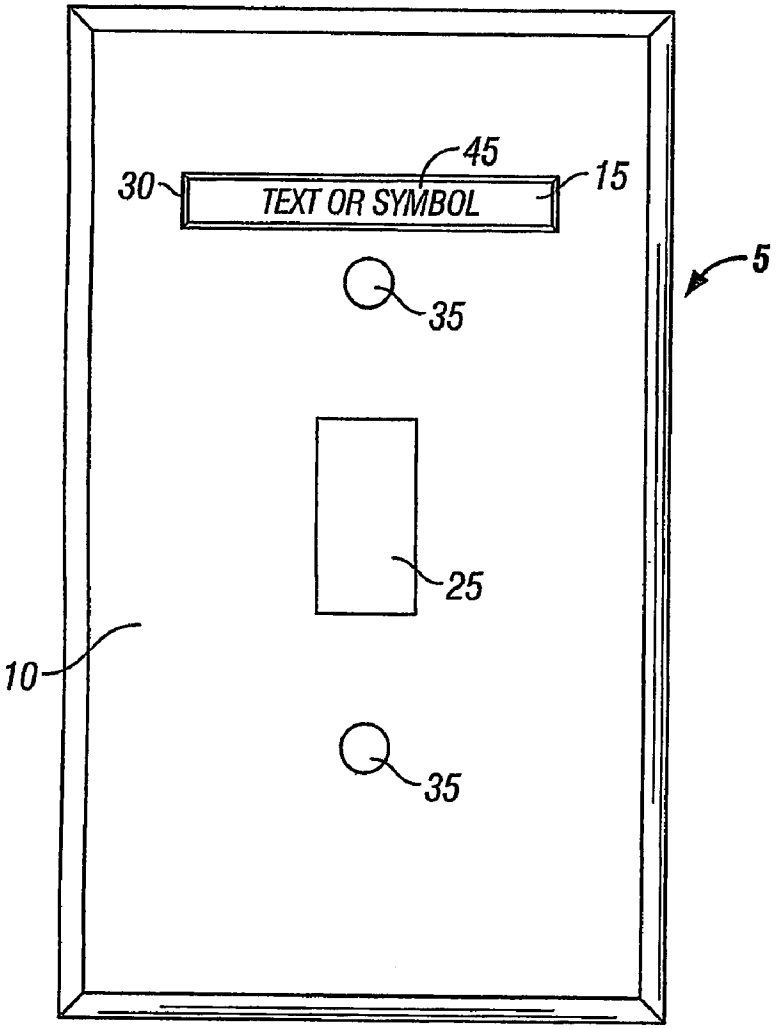
FIG. 1 illustrates an embodiment of the invention showing a switch cover plate with electroluminescent backlighting.

An embodiment of the invention is described with respect to FIG. 1, in which a backlit cover plate 5 comprises a plate 10, a window cover 15, which cover engages the edges of the window 30 thereby permitting the electroluminescent (EL) backlighting 20, more clearly shown in FIG. 2, to emit light through the window 30. Label 45, which displays either text or symbols, is positioned between the EL backlighting 20 and window cover 15 is thereby contrasted and highlighted. Plate 10 has a switch opening 25, a window 30, and at least one plate-securing opening 35. As shown, screws, nails or any other suitable fasteners may be used to secure the plate 10 to a surface through plate-securing openings 35. As previously noted, window 30 is an opening in plate 10, but may also be formed with transparent material (not shown) in lieu of window cover 15. The contrasting text or symbols on label 45 would then be attached to the top of the backlit window 30 without departing from the spirit or intent of the invention.

In the embodiment illustrated in FIG. 1, label 45 containing either text or symbols or both, can be mounted within window 30. Label 45 comprises a foreground and a background. Label 45 is secured within the window 30 by glue, snap fitting, or any other suitable securing method. The background of the label 45 is advantageously comprised of any semirigid, translucent material, preferably clear plastic. The foreground comprises data to be communicated. A variety of lettered or numbered labels known in the art may be used for the data, but preferably individual letters or numbers that have adhesive backing may be used. The opaque letters or numbers in such embodiments are affixed to the background. Window cover 15 covers window 30 and label 45. Window cover 15 is secured to plate 10 by snap fitting within the interior edges of window 30 or any other suitable securing method. Window cover 15 is also comprised of any semi-rigid, translucent material, preferably clear plastic.

FIG. 2 is a plane view of the embodiment of the invention shown on FIG. 1 from the reverse side more clearly disclosing the disposition of the EL backlighting 20. FIG. 2 illustrates the backlit cover plate 5 having a back plate. As shown, EL backlight 20 is secured to plate 10 on the backside of the window 30. EL backlight 20 is secured to the plate 10 by snap fitting, glue, or any other suitable securing method. The materials to form EL backlight 20 are well known in the art. Examples of available electroluminescent materials which can be used for backlight 20 include Durel A3, NEC, and Indiglo. EL backlight 20 illuminates plate 10, window 30, and label 45 and provides at least two EL electrodes through which a potential across the phosphor is provided to illuminate the EL backlight 20, all in a manner well known in the art. A back plate (not shown) can be fashioned to enclose EL backlight 20 and secured to the back side of plate 10, although is not required. This back plate can be secured to plate 10 by glue, snap fitting, or any other suitable securing methods. Alternatively, the electroluminescent material could be molded into the plate 10 and provide a recessed area or window to allow text or symbols to be inserted in the recess or window without departing from the scope of the disclosure contained herein. The backlighting color can be varied by an appropriate choice of phosphor materials, in a manner well known in the industry to provide a variety of colors or hues. Additionally, the backlighting may be accomplished with the use of light emitting diodes (LEDs) which are readily available in the marketplace and which are well known in the industry.

The following describes an exemplary application of the present invention as embodied and illustrated on FIGS. 1 and 2. In operation, connectors 55 are connected to a power source at a light switch on a wall. The light switch controls a light. The power source at the light switch forms an electrical circuit with the light. Plate 10 is then secured to the wall at the light switch. Plate 10 is disposed to enable a light switch to pass through switch opening 25. Screws are inserted through the plate securing openings 35 and are used to secure plate 10 to the light switch and the wall. Through the connectors 55, electricity from the power source flows through the back plate electrodes and to the opposed plates sandwiching the phosphor of the backlight 20. The light switch controls the flow of electricity to the light and EL backlight 20. When the light switch is in the off position, EL backlight 20 is energized, while the electrical circuit to the light is interrupted. The line voltage from the electrical power source potentiates EL backlight 20 via the connectors 55. The light switch is then visually identifiable in the dark via the EL backlighting 20.

When the light switch is in the on position, the electrical circuit to the light is connected, and electricity flows directly to the light, which becomes illuminated. EL backlight 20 is no longer illuminated. If the light does not illuminate when the light switch is turned to the on position, the electrical circuit at the light switch may be checked by viewing backlit cover plate 5. If EL backlight 20 illuminates when the switch is in the off position, voltage is present across EL backlight 20 and the electrical circuit from the power source is functioning properly, and one may conclude the light bulb or light is not functioning properly. The light bulb may then be replaced or the light may be serviced. If EL backlight 20 does not illuminate, no voltage has reached the EL backlight 20 and the electrical circuit at the power source is not functioning properly, which signifies, from an absence of electrical power at the appropriate outlet, that the light switch or power supply may need service.

To identify which particular light the switch controls, window cover 15 may be removed from the plate 10, and label 45 may be mounted within the window 30. The foreground data may be affixed to the background of label 45 in any word, number, or symbol order that identifies the particular light. Window cover 15 is then secured again to plate 10. Label 45 can visually identify the light corresponding to the light switch at all times. When the light switch is turned to the on position, the illumination provided by the light allows a person to view the label 45 and identify the light. When the light switch is turned to the off position and no other external light is available, the illumination of EL backlight 20 illuminates label 45 and allows one to clearly view label 45, which can be fabricated from a variety of colors or hues as previously noted.

Even though the above disclosure describes the backlit cover plate 5 in assembled form, backlit cover plate 5 is also available disassembled (not illustrated), with the following components disassembled from the backlit cover plate 5, plate 10, EL backlight 20, label 45, and window cover 15. In addition, the disassembled components of the backlit cover plate 5 may be packaged together in a kit (not illustrated). The kit may be in any form that is packaged together and available to a consumer.

Even though the above disclosure describes incorporating EL backlight 20 into a light switch plate, the present invention is expressly not limited to such applications, and may be useful in various other applications. The present invention would prove useful in illuminating and identifying power outlets, telephone jacks, and internet jacks.

Figure 3:
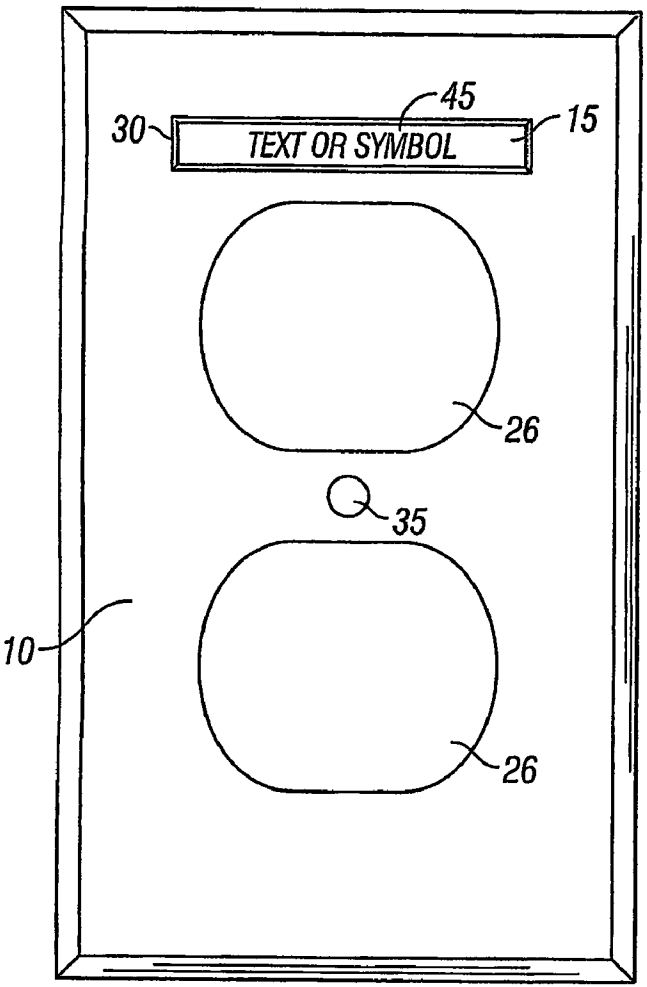
FIG. 3 illustrates another embodiment of the invention showing an outlet cover plate with electroluminescent backlighting.

For example, FIG. 3 discloses another embodiment of the present invention for an electrical outlet plate. Plate 10 is formed from molded plastic in a manner well known to the industry and provides an opening 35 for attaching such plate to an electrical junction box mounted in a wall, all in a manner well known to the electrical trades. The outlet plate of FIG. 3 also provides a window 30, through which text or symbols 45 may be viewed, covered with window cover 15, all as previously described in the description of FIGS. 1 and 2 above. Plate 10 of FIG. 3 provides additional openings 26 for standard electrical receptacles.

Figure 4:
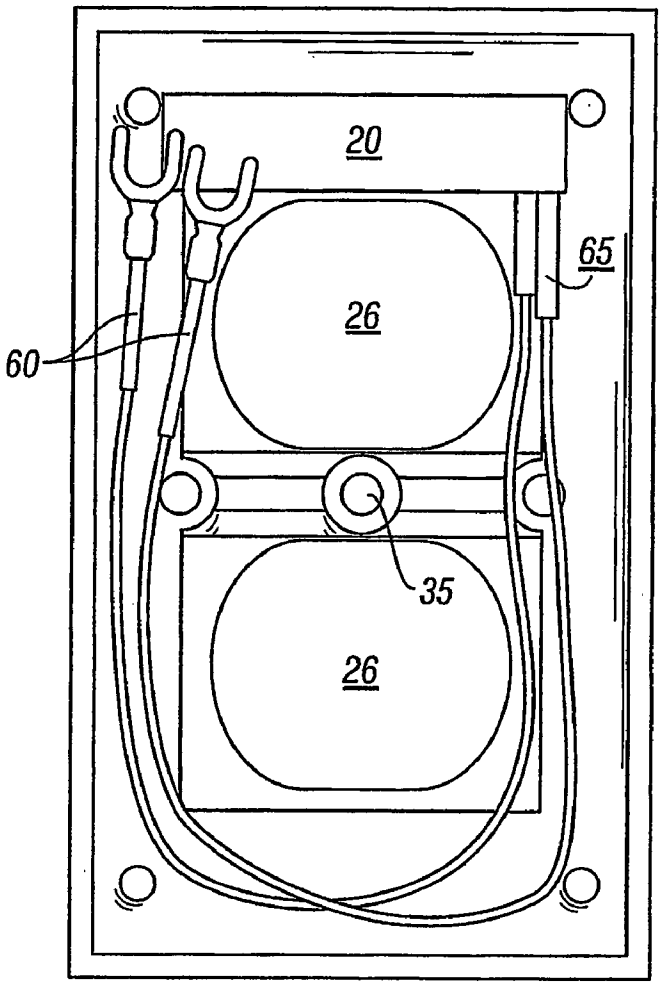
FIG. 4 is a plane view of the embodiment of the outlet cover plate of FIG. 3 from the reverse side.

FIG. 4 discloses the reverse of outlet cover plate 10 of FIG. 3. FIG. 4 further discloses the EL backlight 20 connected to two conductors 65 which provided clips 66 for connection to the electrical service provided to the outlet junction box previously described. A person skilled in the electrical trades can easily substitute any number of available electrical connectors to the conductors which provide the potential to the EL backlight 20 and still remain within the scope of the disclosure made herein. Further, the conductors to the EL backlight can provide appropriate fusing to prevent shortcircuiting of EL backlight 20. When the backlighting is on, the outlet is shown to be provided with electrical service. If the backlighting is off, the electrical service to the outlet has been interrupted and one can readily determine the cause of the absence of the service at the outlet.

The present invention is further not limited to use in electrical outlets disposed in walls. The invention is further not limited to use of electroluminescence for backlighting. Other types of backlighting are known in the art, such as conventional filament lighting or light emitting diodes. It will be further appreciated that the invention may incorporate backlighting into a power plate in any technology or application calling for such functionality.

As described above in the summary sections, it will also be understood that the embodiments are possible covering structures or surfaces other than walls. Further, it will be appreciated that the invention is not limited to embodiments working off AC supply. The invention is equally enabled by embodiments working off DC supply. Any application which specifies the application of an electric field to a dielectric phosphor to release light in a switch or outlet plate for identification of the switch or outlet may be accomplished by the present disclosure.

Although the present invention and its advantages have been described in detail, it should be understood that various changes, substitutions and alterations can be made herein without departing from the spirit and scope of the invention as defined by the appended claims.

I claim:

1. An electrical service cover plate for use with an electrical power supply comprising:

a plate, including a window therein and an opening in the plate for receiving a throw of a switch having an operating mechanism to alternatively connect or disconnect the electrical power supply in said opening;

a backlight, selectively energized by the electrical power supply when the switch interrupts the power supply, mounted on a posterior of said plate so as to illuminate the window when energized; and a label disposed between the window of said plate and said backlight, said label providing a translucent background and an opaque foreground displaying data to be communicated.

2. The electrical service cover plate of claim 1 further comprising a translucent window cover retained over said window.

3. The electrical service cover plate of claim 1 wherein the backlight is an electroluminescent screen.

4. The electrical service cover plate of claim 1 wherein the backlight is an incandescent bulb.

5. The electrical service cover plate of claim 1 wherein the backlight is one or more light emitting diodes.

6. An electrical service cover plate for use with an electrical power supply comprising:

a plate, the plate including a window therein and an at least one opening, an electrical outlet receptacle receivable in said at least one opening;

a backlight, energized by the electrical power supply when power is being supplied to the receptacle, mounted on the posterior of said plate so as to illuminate the window when power is being supplied to the receptacle; and a label disposed between said plate and said backlight, said label providing a translucent background and an opaque foreground displaying data to be communicated.

7. The electrical service cover plate of claim 6 further comprising a translucent window cover retained over said window.

8. The electrical service cover plate of claim 6 wherein the backlight is an electroluminescent screen.

9. The electrical service cover plate of claim 6 wherein the backlight is an incandescent bulb.

10. The electrical service cover plate of claim 6 wherein the backlight is one or more light emitting diodes.

11. An electrical service switch cover for use with an electrical power supply comprising:

a plate having a window, an opening for the throw of a switch, and one or more holes for the attachment of the plate to a surface;

a backlight connected to a posterior of the plate covering the window in the plate;

a label disposed between said plate and said backlight, said label providing a translucent background and an opaque foreground displaying data to be communicated; and electrodes on the backlight for connecting the backlight to a pair of electrical service connectors of the switch to energize the backlight when the switch is off.

12. The electrical service switch cover of claim 11 further comprising a translucent window cover mounted on the window.

13. The cover plate of claim 11, wherein the backlight is provided by a source selected from the following group of light sources: an electroluminescent panel, an incandescent bulb, or one or more light emitting diodes.

14. An electrical service outlet cover for use with an electrical power supply comprising;

a plate having a window, one or more openings for electrical service receptacles, and one or more holes for the attachment of the plate to a mounting surface;

a backlight connected to a posterior of the plate covering the window in the plate;

a label disposed between said plate and said backlight, said label providing a translucent background and an opaque foreground displaying data to be communicated; and electrodes on the backlight for connecting the backlight to a pair of electrical service connectors of the outlet receptacles to energize the backlight.

15. The electrical service switch cover of claim 14 further comprising a translucent window cover mounted on the window.

16. The cover plate of claim 14, wherein the backlight is provided by a source selected from the following group of light sources: an electroluminescent panel, an incandescent bulb, or one or more light emitting diodes.

17. A method for mounting a backlit electrical cover plate to permit identification of and the status of the electrical power to an electrical service point comprising the steps of;

connecting a first conductor of a backlight to the load leg of the electrical service outlet;

connecting a second conductor of a backlight to the common leg of the electrical service outlet; and attaching the cover plate to the surface adjacent the electrical service point.

* * * * *